US006613188B1

(12) United States Patent
Berg et al.

(10) Patent No.: US 6,613,188 B1
(45) Date of Patent: Sep. 2, 2003

(54) FLOORING REMOVAL TOOL

(75) Inventors: Jeffrey P. Berg, 4508 Highberry Rd., Greensboro, NC (US) 27410; Roger F. Berg, 6807 Feagan Ct., Summerfield, NC (US) 27358

(73) Assignees: Jeffrey P. Berg, Greensboro, NC (US); Roger F. Berg, Summerfield, NC (US)

( * ) Notice: Subject to any disclaimer, the term of this patent is extended or adjusted under 35 U.S.C. 154(b) by 206 days.

(21) Appl. No.: 09/854,710

(22) Filed: May 14, 2001

(51) Int. Cl.[7] ..... B32B 35/00

(52) U.S. Cl. ..... 156/344; 156/584; 254/209; 254/211

(58) Field of Search ..... 156/344, 584; 254/199, 200, 202, 203, 208, 209, 210, 211, 213, 219, 227, 242, 262; 294/8.6, 103.1, 104, 119.1, 902; 269/53, 54.5; 16/5

(56) References Cited

U.S. PATENT DOCUMENTS

| | | | | |
|---|---|---|---|---|
| 4,332,371 A | | 6/1982 | Bell et al. | 254/203 |
| 4,533,118 A | | 8/1985 | Thomas et al. | 254/202 |
| 4,560,146 A | | 12/1985 | Thomas et al. | 254/202 |
| 4,640,735 A | | 2/1987 | Murray et al. | 156/584 |
| 4,683,657 A | * | 8/1987 | Anderson et al. | 30/170 |
| 4,779,301 A | * | 10/1988 | Millette | 15/105 |
| 4,906,323 A | | 3/1990 | Thomas | 156/584 |
| 4,948,451 A | | 8/1990 | Foltz | 156/344 |
| 5,002,629 A | | 3/1991 | Nakamura | 156/584 |
| 5,348,608 A | | 9/1994 | Glenn et al. | 156/344 |
| 5,387,308 A | | 2/1995 | Heavrin | 156/584 |
| 5,415,725 A | | 5/1995 | Scharf | 156/584 |
| 5,454,899 A | | 10/1995 | Glenn et al. | 156/344 |
| 5,456,794 A | | 10/1995 | Barrett | 156/584 |
| 5,505,433 A | | 4/1996 | Carmichael et al. | 254/211 |
| 5,720,844 A | | 2/1998 | Hanson | 156/344 |
| 5,830,313 A | | 11/1998 | Smith | 156/584 |
| 5,909,868 A | | 6/1999 | Galella | 254/211 |
| 6,004,426 A | | 12/1999 | Johnson | 156/344 |
| 6,113,075 A | | 9/2000 | McMichael et al. | 254/203 |

OTHER PUBLICATIONS

National Flooring Equipment Catalog, pp. 46–57; undated, possible prior art.

* cited by examiner

*Primary Examiner*—Mark A. Osele
(74) *Attorney, Agent, or Firm*—MacCord Mason PLLC

(57) ABSTRACT

A tool that includes a lifting member adapted to be positioned adjacent to a flooring in a manner that permits an exertion of a force on the flooring is disclosed. The tool includes a pivotable leverage member adapted to communicate an applied force as the exertion force through the lifting member to the flooring to thereby separate the flooring from the subfloor. The lifting member and the pivotable leverage member may be adapted to permit the separation of the flooring from the subfloor as a substantially continuous section. The tool may include a securing feature adapted to secure at least a portion of the flooring to the tool. The securing feature is adapted to secure at least a portion of the flooring to the tool substantially simultaneously with an applied force communicating as an exertion force through the lifting member to thereby separate the flooring from the subfloor.

89 Claims, 6 Drawing Sheets

FLOORING REMOVAL TOOL

BACKGROUND OF THE INVENTION

1. Field of the Invention

The present invention relates generally to a tool including a lifting member and a pivotable leverage member adapted to remove a flooring affixed to a subfloor. More particularly, the present invention relates generally to a tool further including a securing feature adapted to secure at least a portion of a flooring to the tool.

2. Description of the Prior Art

Among challenges relating to flooring of a sheeting type such as carpeting, linoleum, linoleum replacements and the like are the placement and the replacement of the flooring onto a subfloor. An ultimate goal in each instance is obtaining an aesthetic result.

During replacement, removing existing flooring that has been affixed to a subfloor using fasteners, adhesives, or both often creates a greater challenge than applying the new flooring. Many manual and mechanical devices have been developed to assist with the removal of existing flooring. For some, two or more people are required to bring the device to the work site. For others, two or more people are required to use the device at the work site.

Thus, there remains a need for a new and improved tool that includes a lifting member adapted to be positioned adjacent to a flooring in a manner that permits an exertion of a force on the flooring. Additionally, there is a need for a removal tool with a pivotable leverage member adapted to communicate an applied force as the exertion force through the lifting member to the flooring to thereby separate the flooring from the subfloor to which it is affixed. At the same time, there remains a need for a new and improved tool that may further include a securing feature adapted to secure at least a portion of the flooring to the tool.

SUMMARY OF THE INVENTION

The present invention is directed to a tool that includes a lifting member adapted to be positioned adjacent to a flooring in a manner that permits an exertion of a force on the flooring. Also, the tool includes a pivotable leverage member adapted to communicate an applied force as the exertion force through the lifting member to the flooring to thereby separate the flooring from the subfloor. The lifting member and the pivotable leverage member may be adapted to permit the separation of the flooring from the subfloor in substantially continuous sections.

In an embodiment, the tool includes a securing feature adapted to secure at least a portion of the flooring to the tool. The securing of the flooring to the tool may be continuous or momentary. In either case, the securing occurs substantially simultaneously with an applied force communicating as an exertion force through the lifting member. In this manner, a section of flooring may be separated from the subfloor.

In a preferred embodiment, the securing feature includes a pivotable leverage member having a first length pivotally joined to a second length. The lengths are prescribed to permit securing a portion of the flooring to the tool. Preferably, the first length and the second length are adapted to permit a cooperation of the pivotable leverage member and the lifting member to secure a portion of the flooring to the tool. In such a case, the lifting member has a rigidity adapted to permit a portion of the flooring to be secured to the tool by the cooperation of the pivotable leverage member and the lifting member.

The securing feature may be substantially continuous. Alternatively, the securing feature may include a plurality of elements. For example, applicants have found that a plurality of elements, such as space arcuate members, work well. These spaced arcuate members may be placed on the tool to create a passage through, which a section of flooring may pass. In this way, the securing feature may grip the flooring substantially simultaneously with an applied force communicating as the exertion force through the lifting member. This type of cooperation of the securing feature, the pivotable leverage member and the lifting member, permits the tool to be used to separate a section of flooring using a repeated forward and backward movement of the pivotable leverage member. The arcuate members may further include serrations adapted to grip a portion of the flooring.

In an alternative embodiment, the securing feature may be integral with the pivotable leverage member. In such case, the integral securing feature may further include a biasing member adapted to assist in securing a portion of the flooring to the tool and a retractor adapted to permit release of the portion of the flooring. Again, this type of securing feature permits the tool to be used to separate a section of flooring using a repeated forward and backward movement of the pivotable leverage member.

The lifting member may be of a size that permits a substantially continuous section of the flooring to be wrapped thereon. Preferably, the pivotable leverage member and the lifting member are adapted to permit the relatively complete separation of a substantially continuous section of the flooring from the subfloor without wrapping the substantially continuous section of the flooring on the tool.

In a preferred embodiment, the applied force may be applied manually, and preferably one person may direct the applied force.

The tool may include a cutting mechanism adapted to cut the flooring to facilitate removal of a substantially continuous section of the flooring from the subfloor. The cutting mechanism may be adapted to cut the flooring substantially simultaneously with an applied force communicating as the exertion force. The cutting mechanism may be removably fastened to the tool. The cutting mechanism may include a stop adapted to permit a relative movement of the lifting member and the cutting mechanism.

The tool may include a guide member adapted to direct a separated section of the flooring during further separation of a substantially continuous section of the flooring from the subfloor. The guide member preferably directs the substantially continuous section of the flooring away from the lifting member to reduce or eliminate any entanglement of the substantially continuous section with the lifting member that may occur otherwise. The guide member may include a directional-movement feature that defines a passage into which a section of the flooring, which may be substantially continuous, may be directed. The directional-movement feature is adapted to prevent withdrawal of a substantially continuous section of the flooring from the passage when the substantially continuous section of the flooring is inserted through the passage in one direction. A way to accomplish the unidirectional movement is to include arcuate members having a unidirectional gripping feature such as serrations and a biasing mechanism for ensuring a contact of the gripping feature against the separated flooring as the flooring passes through the passage. In this manner, the directional-movement feature facilitates a repeated forward and backward movement of the pivotable leverage member to advance the flooring as it is separated from the subfloor. The guide may be removably fastened to the tool.

In an embodiment, the pivotable leverage member and the lifting member may be integral to facilitate their coordinated cooperative movement. In this case, the pivotable leverage member is fixed firmly to the lifting member The lifting member is generally arcuate, preferably may be generally cylindrical, and more preferably, a cylinder. The lifting member may be a plurality of spaced wheels. Alternatively, the lifting member may be a solid cylinder. The lifting member may be adapted to smooth new flooring. For example, a plurality of spaced wheels or a cylinder, which preferably are rotatably mounted, used as the lifting member may assist in smoothing the new flooring during installation. The tool may include a positioning member movably mounted to the tool. The positioning member may provide greater flexibility in positioning the tool when initiating the removal of a floor. To that end, the positioning member may include a handle adapted to assist with positioning the tool. An option that may be included in the tool is a structure for temporarily attaching the handle to facilitate the handle's storage when it is not in use. Variations of such attachment structures will be determined by those skilled in the art.

In a preferred embodiment, the tool is manually movable; preferably one person may move the tool. The manual movement may involve rolling of a portion of the lifting member. When the pivotable leverage member has a first length pivotally joined to a second length, applicants believe that a locking feature may be particularly advantageous for facilitating movement of the tool when the securing feature involves cooperation of the pivotable leverage member and the lifting member, particularly a lifting member that is axially mounted.

The tool may include a removably fastened starting mechanism. The starting mechanism may include a link having a first end adapted to connect to the tool and a second end adapted to connect to a portion of the flooring. A link may be any one of a strap, a chain, a cable, a rope or a combination thereof.

Applicants have found that the tool works particularly well in removing carpeting and believe that the tool would work well to remove other flooring that is a sheet product such as any one of a linoleum, a linoleum replacement, a vinyl, and the like.

Accordingly, one aspect of the present invention is to provide a tool for removing a flooring affixed to a subfloor. Such tool includes a lifting member adapted to be positioned adjacent to the flooring in a manner that permits an exertion of a force on the flooring. Also, the tool includes a pivotable leverage member adapted to communicate an applied force as the exertion force through the lifting member to the flooring to thereby separate the flooring from the subfloor.

Another aspect of the present invention is to provide a tool that includes a lifting member adapted to be positioned adjacent to the flooring in manner that permits an exertion of a force on the flooring. Also, the tool includes a pivotable leverage member adapted to communicate an applied force as the exertion force through the lifting member to the flooring to thereby separate the flooring from the subfloor. Further, the lifting member and the pivotable leverage member are adapted to permit the separation of the flooring from the subfloor as a substantially continuous section.

Still another aspect of the present invention is to provide a tool that includes a lifting member adapted to be positioned adjacent to the flooring in a manner that permits an exertion of a force on the flooring. Also, the tool includes a pivotable leverage member adapted to communicate an applied force as the exertion force through the lifting member to the flooring to thereby separate the flooring from the subfloor. Further, the lifting member and the pivotable leverage member are adapted to permit the separation of the flooring from the subfloor as a substantially continuous section. Additionally, the tool includes a securing feature adapted to secure at least a portion of the flooring to the tool.

These and other aspects of the present invention will become apparent to those skilled in the art after a reading of the following description of the preferred embodiment when considered with the drawings.

DESCRIPTION OF THE PREFERRED EMBODIMENTS

Figure 1:
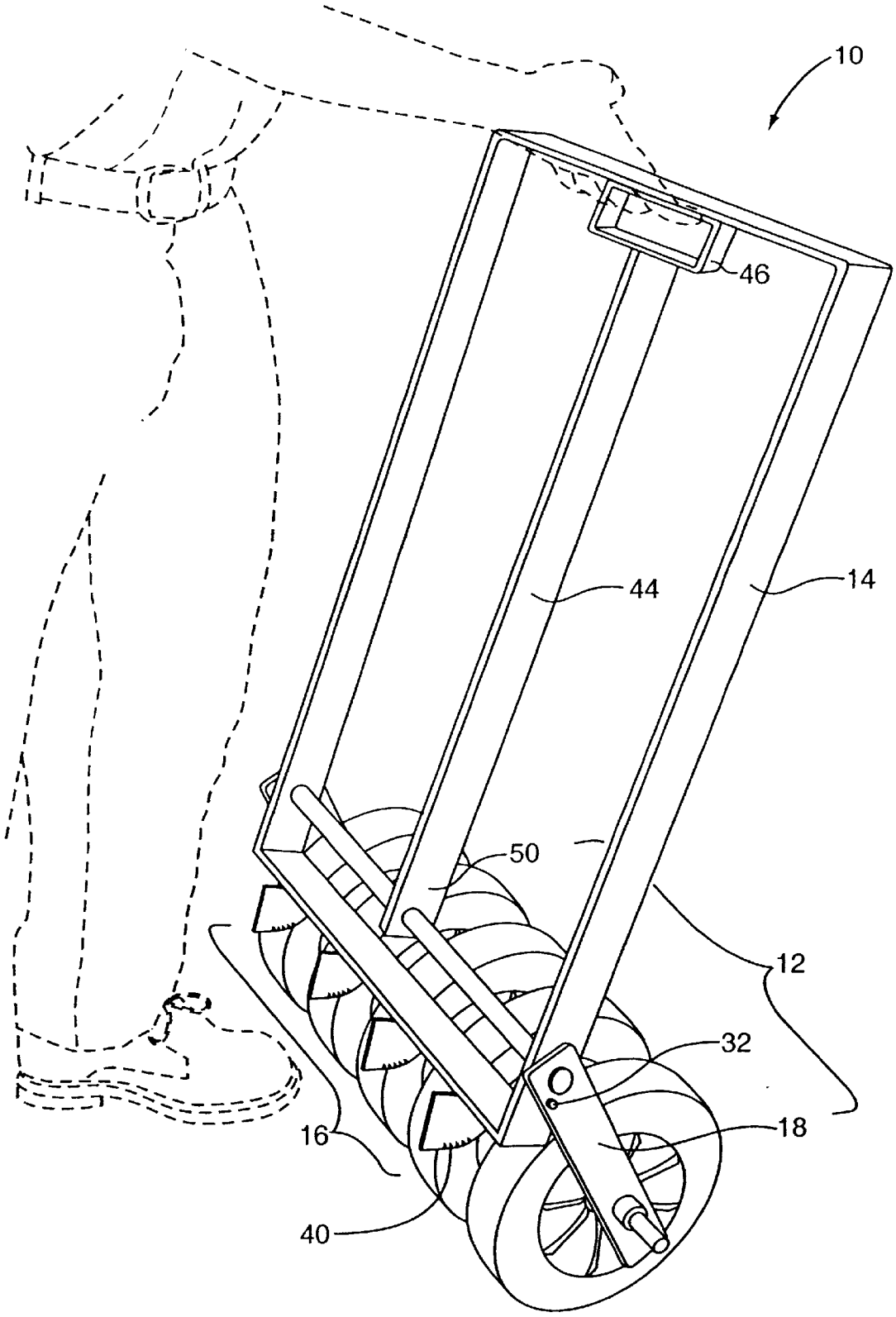
FIG. 1 depicts a person standing alongside a tool including a lifting member and a pivotable leverage member according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a tool, generally designated 10, is shown constructed according to the present invention. The tool 10 includes a lifting member 12 and a pivotable leverage member 14. The lifting member 12 is adapted to be positioned adjacent to the flooring in a manner that permits an exertion of a force on the flooring to separate it from a subflooring to which it is affixed. The pivotable leverage member 14 is adapted to communicate an applied force as the exertion force through the lifting member 12 to the flooring. In this manner a mechanical advantage is achieved. Further, a securing feature 16 may be included to temporarily secure the flooring to the tool 10 during use.

An optional feature that may be included with tool 10 is a positioning member 44 movably attached to tool 10 at a first end 50 and including a handle 46 at a second end. As seen in FIGS. 1, 2A, 2B, and 2C, the positioning member may be used to place the tool 10 if it is desired to disengage the lever member 14 from the lifting member 12. The positioning member 44 may include an attachment structure for temporarily affixing the member 44 to the tool, for example, for the storage of the positioning member 44. Variations of such attachment structures will be determined by those skilled in the art.

The tool 10 of FIG. 1 may be made from commercially available components that may be cut, adapted, and joined to accomplish the function of the present invention. For example, commercially available aluminum was cut and welded to create the pivotable leverage member 14 and the securing feature 16. Commercially available about 8 inch diameter wheels (Model or Part No. 623685 available from Roll-Tech Inc. of Hickory, N.C. and described in their D24 catalogue available online at http://www.rolltech.net/Catalog/, the subject matter of which is incorporated by reference herein in its entirety) mounted on an about ¾ inch diameter axel, were used to create lifting member 12.

Although the tool 10 of FIG. 1 was created using commercially available aluminum and wheels, applicants contemplate that any materials that fulfill the function of the present invention will be suitable. For example, other metals and alloys, polymers, composites of metals, alloys, polymers, and ceramic such as fiber-reinforced composites, and any combinations thereof may be used on one, both, or all of the lifting member 12, the pivotable leverage member 14, and the securing feature 16. Further, the lifting member 12 may be a continuous member such as that depicted in FIG. 4A.

When a pivotable leverage member 14 of the tool 10 includes a lower portion 18, it may be advantageous to include a locking feature 32 that may be used to lock the lower portion 18 of the pivotable leverage member 14. Such a locking feature 32 may be particularly advantageous when a securing feature 16 involves cooperation of the pivotable leverage member 14 and the lifting member 12. In this manner, the pivotable leverage member 14 may be prevented from engaging the lifting member 12. In this way, if the lifting member is attached to the pivotal leverage member 14 as a rotating body, an operator may wheel the tool 10 to and from work sites. Applicants contemplate that the locking feature 32 may be any configuration, and assemblage of the components achieves the desired function. Such structures will be understood to those skilled in the art.

An operator is depicted in FIG. 1 as holding a tool 10 according to the present invention. By this depiction, applicants intend to give a sense of the size of one embodiment of the present invention; however, applicants emphasize that the size and shape of a tool 10, according to the present invention, may include any one of a smaller, larger, wider, and narrower tool, such as to achieve the purpose of the present invention. For example, the tool 10 may be of a size that permits operation only by gripping with one hand.

The operation of tool 10, and in particular securing features 16, may become better understood by referring to FIGS. 2A, 2B, 2C, and 3. In particular, 2A, 2B, 2C, and 3 show a lifting member 12, a pivotable leverage member 14, and a lower portion 18. In this embodiment, the lifting member 12, the pivotable leverage member 14, and the lower portion 18 cooperate as a securing feature 16. An end of the pivotable leverage member 14, away from a handle, includes a plurality of arcuate elements. Each element includes a plurality of serrations 40. Also, each element may act on a corresponding wheel when the pivotable leverage member 14 is moved relative to the lifting member 12 to align with the lower portion 18.

Figure 2C:
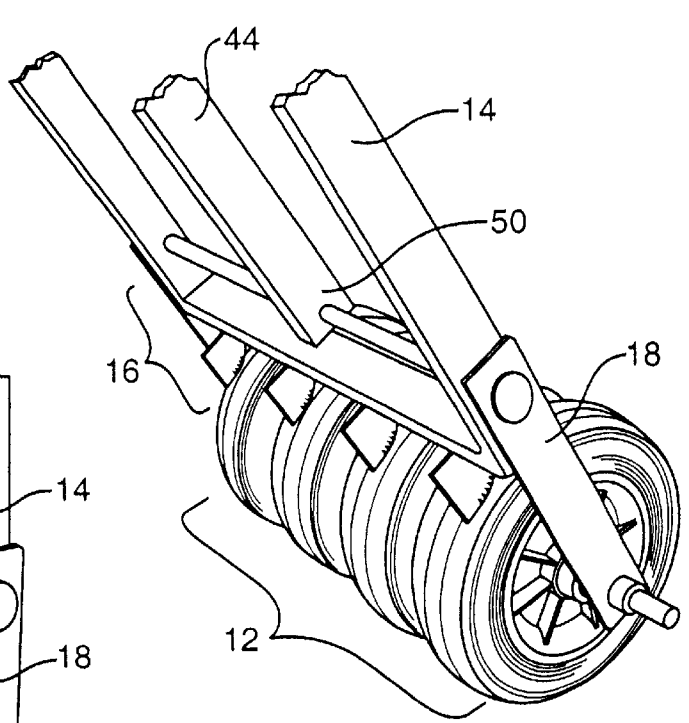
FIGS. 2A, 2B and 2C depict alternative use positions of the tool of FIG. 1 including a securing feature.
Figure 2B:
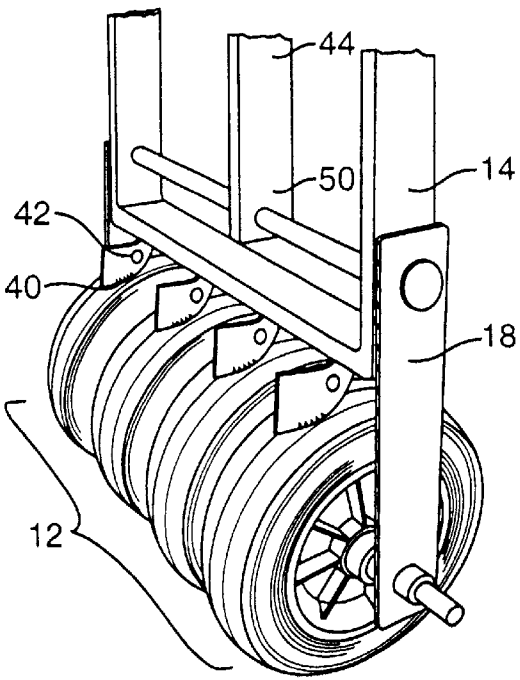
Figure 2A:
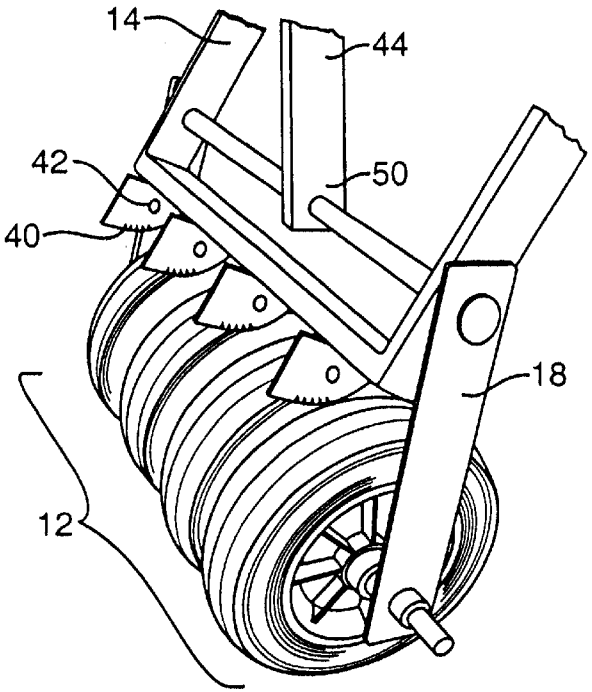
Figure 3:
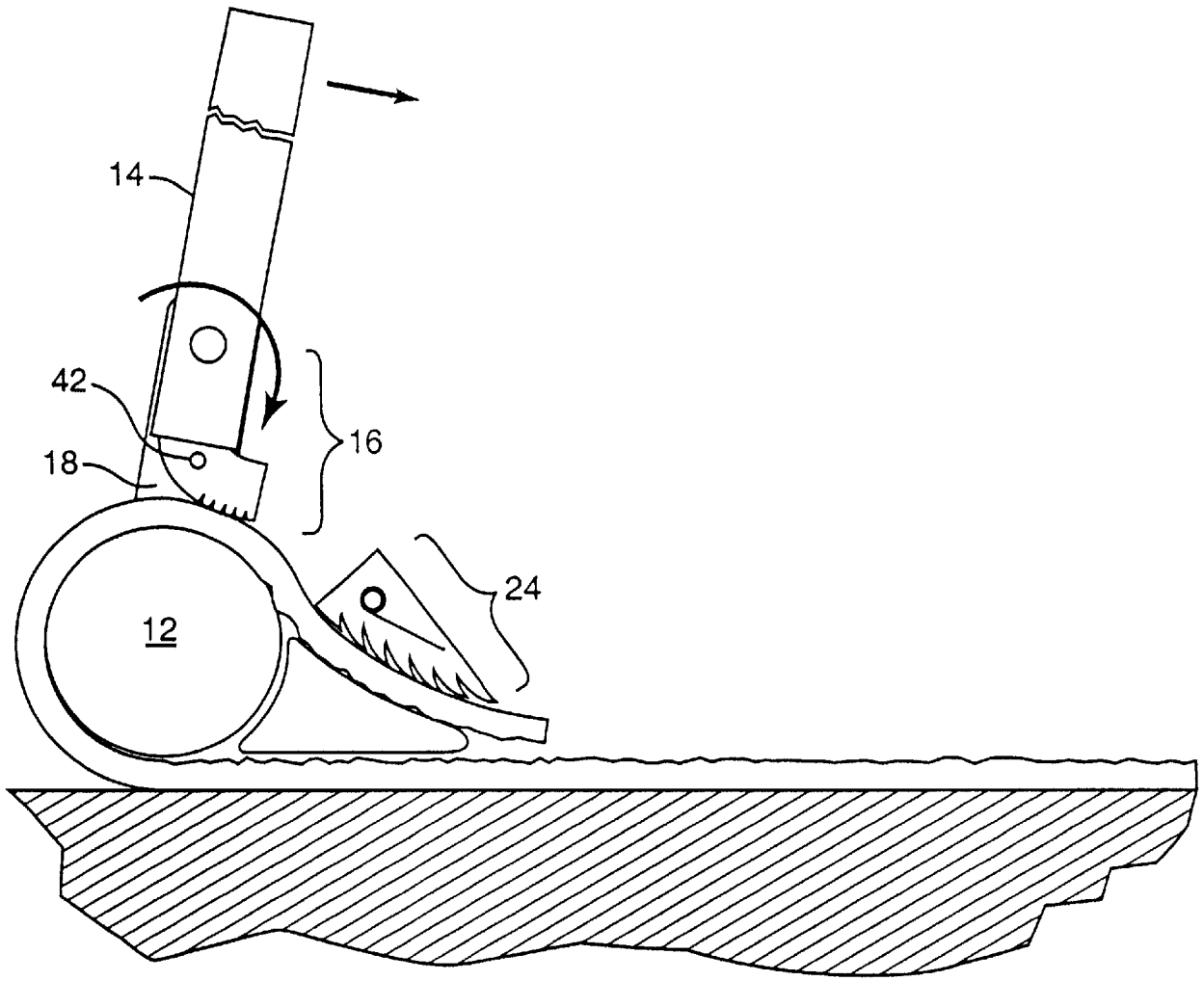
FIG. 3 depicts a cross-sectional schematic of the tool of FIGS. 1, 2A, 2B and 2C including a lifting member adapted to be positioned adjacent to a section of flooring in a manner that permits an exertion of a force on the flooring and a pivotable leverage member adapted to substantially simultaneously communicate an applied force as the exertion force through the lifting member to the flooring to thereby separate the section of flooring from the subfloor.

A portion of flooring may be inserted into a space created when the pivotable leverage member 14 moves with respect to the lower portion 18, as depicted in FIG. 2A. After the flooring is inserted in the space, the pivotable leverage member 14 is realigned with the lower portion 18 so that the plurality of arcuate elements engage the flooring biasing against the lifting member 12, as shown in FIG. 2B. An operator may then pull on the pivotable leverage member 14 to cause the securing feature 16 to tighten against the flooring substantially simultaneously with lifting member 12 exerting an applied force transmitted through the pivotable leverage member 14 to the flooring as shown in FIG. 2C (a flooring is not depicted). This act lifts the flooring from the subfloor to which it is affixed, thereby separating them as shown in FIG. 3. The steps are repeated to first advance the newly lifted flooring and to continue separating the flooring affixed to the subfloor.

Advantages of tool 10 of the present invention include, among others, the removal of continuous sections of flooring from the subfloor to which the section is affixed; maintaining the removed flooring away from the subfloor thereby minimizing and/or preventing the removed flooring from reaffixing; and the removal of flooring without wrapping the removed flooring about the tool 10 or about lifting member 12. Other advantages of tool 10 include its ease of operation; the ability to have a size, shape and weight that makes tool 10 extremely portable; and a size, shape and weight that allows operation by a single person. The portability may be particularly beneficial when transporting the tool 10 in a subway, on a bus, and in older tenements having only a stairway or a small elevator.

FIGS. 1–3 depict one arrangement for a securing feature 16 according to the present invention, and applicants contemplate that a variety of arrangements would work. For example, FIG. 4A shows a securing feature 16 that is integral with a pivotable leverage member 14 and works without the cooperation of the lifting member 12. In FIG. 4A, the lifting member 12 is a cylinder that is rotatably mounted to the lower portion 18 of the pivotable leverage member 14.

Figure 4B:
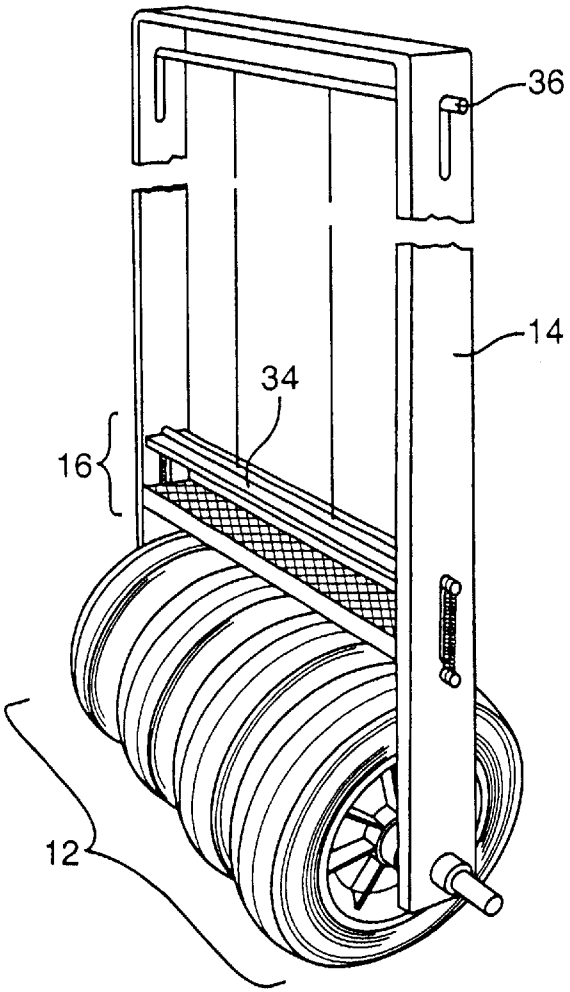
FIG. 4B depicts another alternative embodiment of the tool according to the present invention including a lifting member and a pivotable leverage member.
Figure 4A:
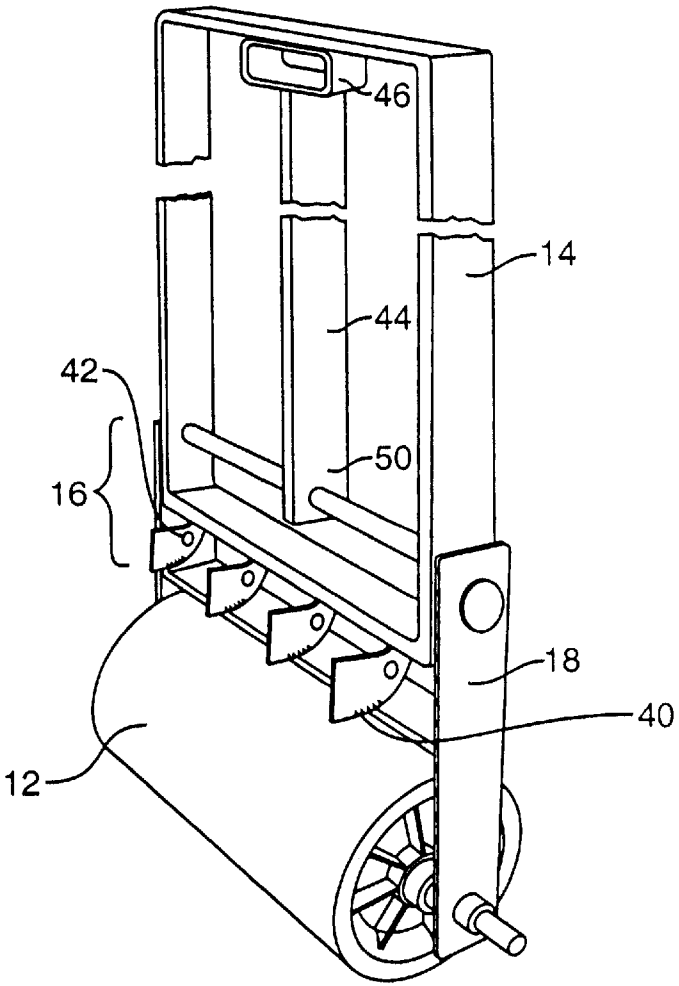
FIG. 4A depicts an alternative embodiment of the tool according to the present invention including a lifting member and a pivotable leverage member.

Another alternative securing feature 16 is depicted in FIG. 4B in which the pivotable leverage member 14 is a unitary frame. As with the embodiment in FIG. 4A, the lifting member 12 is not engaged. Here, the securing feature 16 includes at least one biasing element that facilitates the biting of a biasing member 34 against a section of flooring during separation from the subfloor. Another aspect of securing feature 16 of FIG. 4B, is a retractor 36 that allows an operator to retract the biasing member 34 to create a gap into which the flooring may be initially placed and subsequently advanced.

Figure 5:
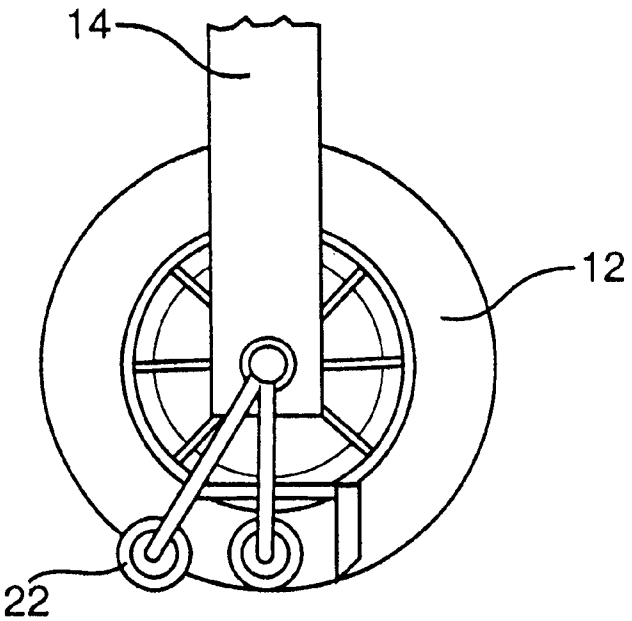
FIG. 5 depicts a removably attachable cutting mechanism that may be included with the tools of FIGS. 1–4 according to the present invention.

A continual operation of the tool 10, according to the present invention, may be facilitated by a cutting mechanism 22, such as that depicted in FIG. 5. Such a cutting mechanism may be attached through an axis holding the wheels that makes up a lifting member 12, or any other appropriate manner. A stop may be included as part of the cutting mechanism 20 to permit a relative movement of the pivotable leverage member 14, lifting member 12, and the cutting mechanism 20. In FIG. 5, a section of flooring being removed from the subfloor to which it is affixed would travel counter-clockwise about lifting member 12 as cutting mechanism 20 cuts. Although a single cutting mechanism 20 is shown in FIG. 5, a pair of cutting mechanisms 20, and even a plurality of cutting mechanisms 20, may be added to cut sections of the flooring that is removed from the corresponding subfloor to which it is affixed.

Figure 6:
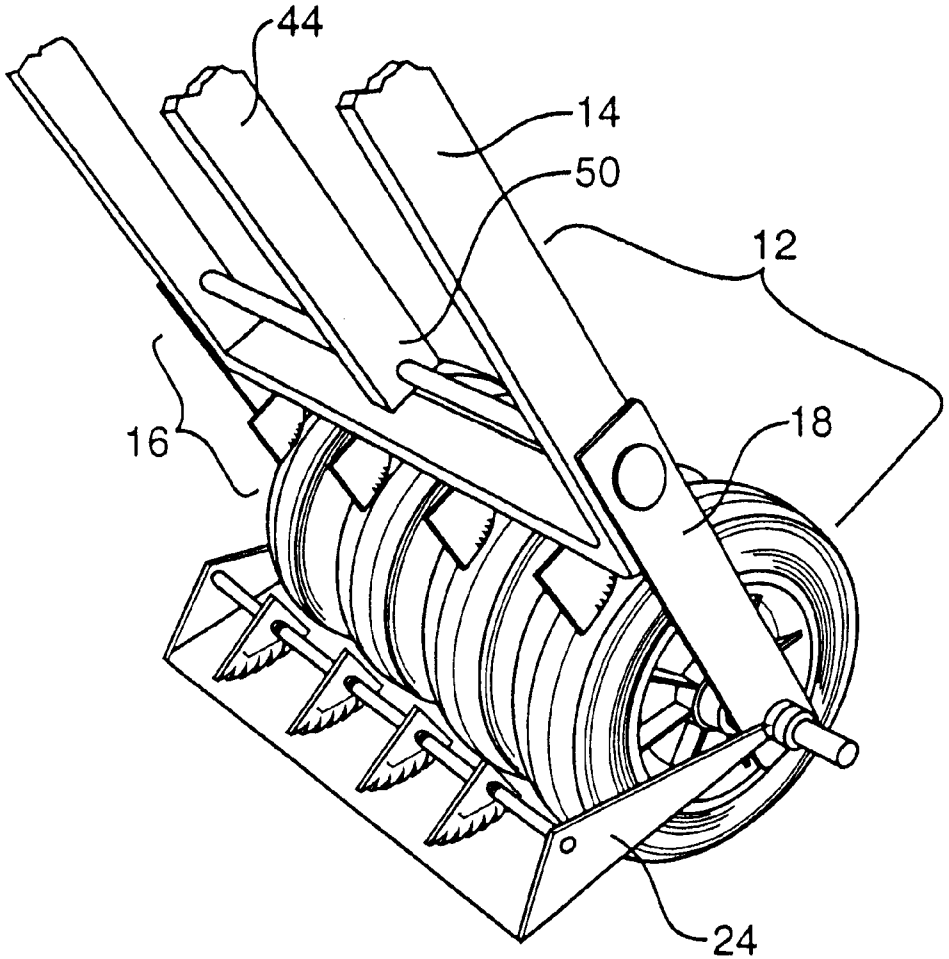
FIG. 6 depicts a removably attachable guide member adapted to direct a section of flooring during further separation of the flooring from the subfloor that may be included with the tools of FIGS. 1–4 according to the present invention.

A guide member 24, as shown in FIG. 6, may also facilitate a continual operation of the tool 10 according to the present invention. That is, as a section of flooring is removed, the guide member 24 may act to hold the removed section and to permit a fluid operation of tool 10. The guide member 24 facilitates the reciprocal movement of the tool 10 and the advancement of removed flooring. In FIG. 6, a section of removed flooring travels clockwise about lifting member 12, and is thus held down to prevent interference with the movement of pivotal member 14 relative to the lifting member 12 during the removal of the flooring.

Figure 7C:
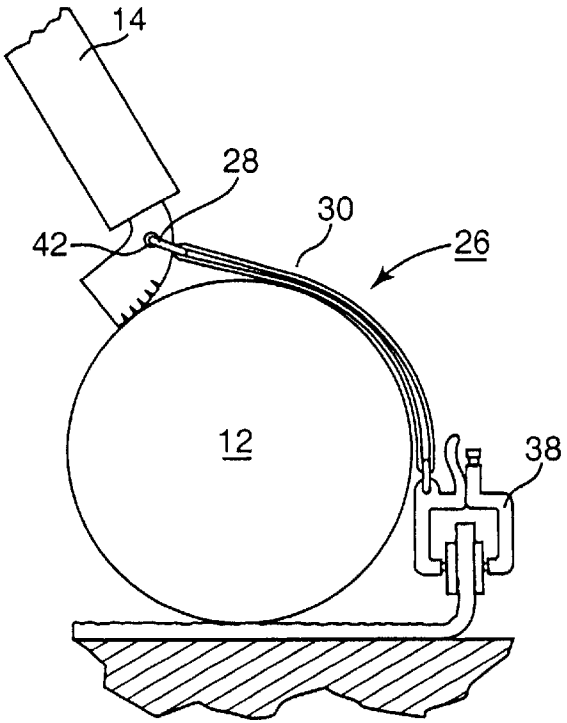
FIGS. 7A, 7B and 7C depict alternative starting mechanisms that may be included with the tools of FIGS. 1–6 according to the present invention.
Figure 7B:
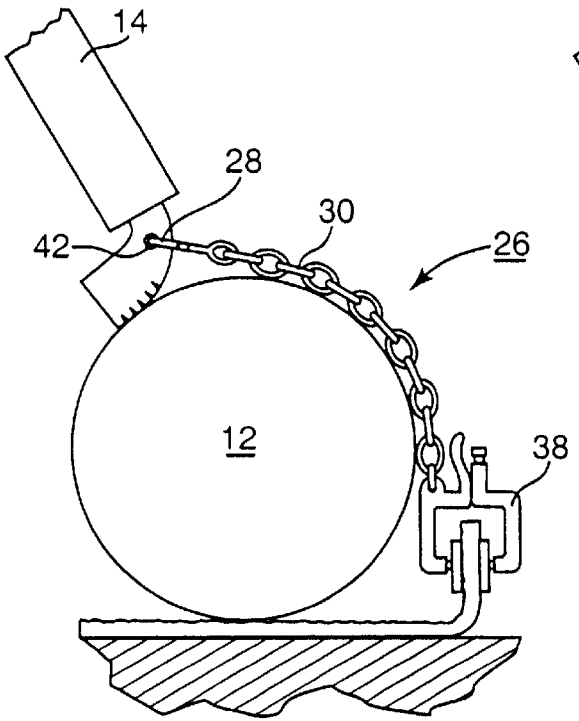
Figure 7A:
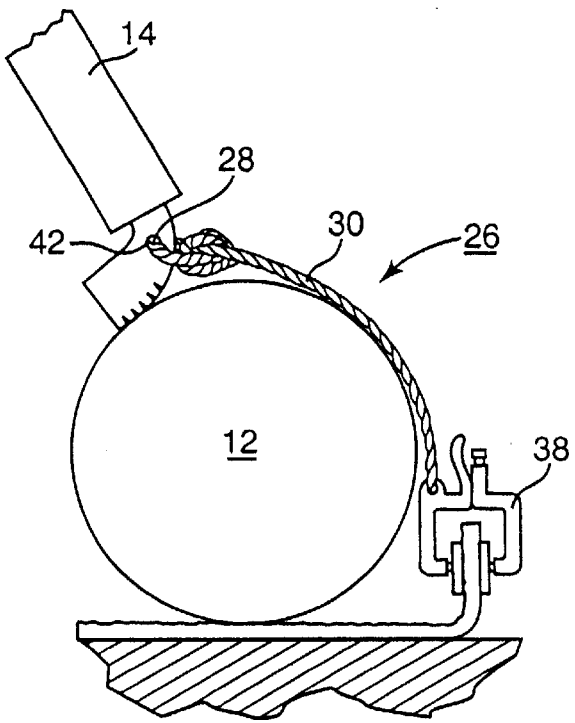

Although applicants have found that the flooring removal tool of the present invention works exceptionally well in unrestricted areas, in confined areas applicants believe that it would be beneficial to initiate the flooring removal with a starting mechanism 26. Examples of flooring starting mechanisms are depicted in FIGS. 7A, 7B and 7C. A starting mechanism 26 may be removably attachable to a tool 10. A starting mechanism 26 may be attached, for example, to the pivotable leverage member 14. The starting mechanism 26 may include a link 30 and a first end 28 for attaching to the tool 10 and a second end 38 for attaching to the floor. A variety of materials may be used as the length 30 such as, for example, a strapping, a chain, a cable, a rope, or a combination thereof. Applicants have found that such a starting mechanism 26 is very advantageous since the adhesives used in applying flooring are tenacious. Also, it is difficult to get the tool 10 into spaces such as corners at the juncture of a subfloor, and a wall or a subfloor and two walls. Variations of such starting mechanisms will be determined by those skilled in the art. Some such variations are shown in the patent literature in, for example, U.S. Pat. No. 5,387,308 (see e.g., FIGS. 2, 3 and 4); U.S. Pat. No. 4,906,323 (see e.g., FIGS. 1 and 2); U.S. Pat. No. 5,505,433 (see e.g., FIGS. 1, 4, 5, 6A, and 6B); U.S. Pat. No. 5,909,868 (see e.g., FIG. 4); U.S. Pat. No. 4,533,118 (see e.g., FIGS. 1, 5 and 7); U.S. Pat. No. 4,560,146 (see e.g., FIGS. 1, 5 and 7); and U.S. Pat. No. 5,456,794 (see e.g., FIGS. 4 and 5). The disclosure of each of these patents is incorporated by reference herein.

Although, the flooring removal tool 10 of the present invention has been depicted as having a rotatably mounted lifting member 12, applicants contemplate that the floor lifting member might be fixably mounted to, for example, the pivotable leverage member 14 or the lower portion 18 of the pivotable leverage member. Further, the lifting member 12 may have a generally arcuate form and preferably has a cylindrical form. The cylindrical form, as demonstrated by the figures, may include either a plurality of elements that create a substantially cylindrical shape or a solid member, as depicted in FIG. 4A.

With respect to the securing feature 16, it is beneficial that it have sufficient action to bite into the flooring to assure that as the flooring is being separated from the subfloor, it remains within securing feature 16. To that end, for example, when wheels of rubber are used, the rubber preferably has a hardness so as to create sufficient bias between the serrated portions 40 of the securing feature 16 and the other elements cooperating as the securing feature 16.

Those skilled in the art will appreciate that sheet flooring, for which the tool 10 may be used to remove, may include carpet, linoleum, a linoleum replacement, and vinyl. Further, those skilled in the art will appreciate that vinyl has replaced linoleum as the dominant flooring material yet, people still refer to any sheet flooring as linoleum.

TABLE 1

Present Invention Compared to the Prior Art

| | Cost | Ease of Transport | Reliability | Ease of Use | Effectiveness | Product of Previous Columns |
|---|---|---|---|---|---|---|
| Invention | 5 | 5 | 5 | 5 | 5 | 3125 |
| | | | PRIOR ART | | | |
| Portable/Mechanized | 3 | 4 | 4 | 4 | 3 | 576 |
| Large/Mechanized | 1 | 1 | 4 | 2 | 4 | 32 |
| Portable/Non-Mechanized | 5 | 4 | 3 | 3 | 3 | 540 |

Table 1 summarizes a comparison between the present invention and various prior art tools. The cost, ease of transport, reliability, ease of use, and effectiveness of the invention and portable/mechanized, large/mechanized and portable/non-mechanized tools are rated from 1 to 5. An inadequate or poor rating is given a 1, a neutral rating is given a 3, and an exceptional rating is given a 5. A rating between inadequate or poor and neutral is given a 2 and a rating between neutral and exceptional is given a 4. To evaluate the combined rating, the rating for each category for the present invention and the prior art was determined. The present invention is clearly superior, having a product rating of 3125.

Some examples of tools that are commercially available may be found in the National Flooring Equipment: Flooring Tools & Equipment catalogue from National Carpet Equipment, Inc. Minneapolis, Minn. (having an Internet address at http://www.nationalequipment.com). In particular, on pages on pages 46–57 of the catalogue are examples of the Portable/Non-Mechanized (see e.g., the tools offered on pages 54–55); Large/Mechanized (see e.g., the tool offered on pages 48); and Portable/Mechanized (see e.g., the tools offered on pages 46–47). The subject matter of this catalogue is incorporated by reference herein in its entirety.

Other examples of the Portable/Non-Mechanized (see e.g., U.S. Pat. Nos. 5,387,308; 4,906,323; 5,505,433; and U.S. Pat. No. 5,909,868); the Large/Mechanized (see e.g., U.S. Pat. Nos. 5,830,313 and 5,002,629); and the Portable/

Mechanized (see e.g., U.S. Pat. Nos. 6,113,075; 6,004,426; 4,948,451; 5,415,725; 5,720,844; 4,332,371; 4,533,118; 4,560,146; 5,348,608; 5,454,899; and U.S. Pat. No. 5,456,794) tools are found in the patent literature. The entire disclosure of each of these patents is incorporated by reference herein.

Certain modifications and improvements will occur to those skilled in the art upon a reading of the foregoing description. By way of example, lifting member 12 may be made from a section of commercially available piping such as that used to transport water, petroleum, or natural gas. The pipe for these uses is commonly a plastic such as poly (vinyl chloride) (PVC), polyethylene (PE), acrylonitrile-butadiene-styrene (ABS) and polybutylene (PB). A variety of other materials such as metals, plastic, and composites may be used. Other plastics that may be used include chlorinated PVC (CPVC), ultrahigh molecular weight (UHMW) PE, and cross-linked PE, co-extruded foam-core ABS that has a foam core sandwiched between solid skins, polypropylene (PP), poly (vinylidene chloride), poly (vinylidene fluoride), cellulose acetate butyrate (CAB), acetal homopolymer resins, rubber-modified systems, polytetrafluoroethylene (PTFE), and fluorinated ethylene-propylene (FEP) copolymer. One such pipe is sold under the AMERIDUCT trademark. It should be understood that all such modifications and improvements have been deleted herein for the sake of conciseness and readability but are properly within the scope of the following claims.

We claim:

1. A tool for removing a flooring affixed to a subfloor, said tool comprising:

(a) a lifting member adapted to be positioned adjacent to said flooring in a manner that permits an exertion of a force on said flooring;

(b) a pivotable leverage member adapted to communicate an applied force as said exertion force through said lifting member to said flooring to thereby separate said flooring from said subfloor; and (c) a securing feature adapted to secure at least a portion of said flooring to said tool, wherein said securing feature is integral with said pivotable leverage member and said integral securing feature further includes a biasing member adapted to assist securing said at least a portion of said flooring to said tool and a retractor adapted to permit release of said at least a portion of said flooring.

2. The tool according to claim 1 wherein said securing feature is adapted to secure at least a portion of said flooring to said tool substantially simultaneously with said applied force communicating as said exertion force through said lifting member to thereby separate said flooring from said subfloor.

3. The tool according to claim 1 wherein said securing feature includes said pivotable leverage member having a first length pivotally joined to a second length to permit securing said at least a portion of said flooring to said tool.

4. The tool according to claim 3 wherein said first length and said second length are adapted to permit cooperation of said pivotable leverage member and said lifting member to secure said at least a portion of said flooring to said tool.

5. The tool according to claim 4 wherein said lifting member has a rigidity adapted to permit said cooperation of said pivotable leverage member and said lifting member to secure said at least a portion of said flooring to said tool.

6. The tool according to claim 1 wherein said securing feature is substantively continuous.

7. The tool according to claim 1 wherein said securing feature includes a plurality of elements.

8. The tool according to claim 7 wherein said plurality of elements are arcuate members.

9. The tool according to claim 8 wherein said arcuate members further include serrations adapted to grip said at least a portion of said flooring.

10. A tool for removing a flooring affixed to a subfloor, said tool comprising:

(a) a lifting member adapted to be positioned adjacent to said flooring in a manner that permits an exertion of a force on said flooring;

(b) a pivotable leverage member adapted to communicate an applied force as said exertion force through said lifting member to said flooring to thereby separate said flooring from said subfloor, wherein said lifting member and said pivotable leverage member are adapted to permit the separation of said flooring from said subfloor as substantially continuous sections; and (c) a securing feature adapted to secure at least a portion of said flooring to said tool, wherein said securing feature is integral with said pivotable leverage member and said integral securing feature further includes a biasing member adapted to assist securing said at least a portion of said flooring to said tool and a retractor adapted to permit release of said at least a portion of said flooring.

11. The tool according to claim 10 wherein said lifting member has a size that permits a substantially continuous section of said flooring to be wrapped thereon.

12. The tool according to claim 10 wherein said pivotable leverage member and said lifting member are adapted to permit the substantial complete separation of a substantially continuous section of said flooring from said subfloor without wrapping said substantially continuous section of said flooring on said tool.

13. The tool according to claim 10 wherein said applied force is applied manually.

14. The tool according to claim 13 wherein said applied force can be applied by one person.

15. The tool according to claim 10 further including a cutting mechanism adapted to cutting said flooring to facilitate a removal of a substantially continuous section of said flooring from said subfloor.

16. The tool according to claim 15 wherein said cutting mechanism is adapted to cut substantially simultaneously with said applied force communicating as said exertion force.

17. The tool according to claim 15 wherein said cutting mechanism is removably fastened to said tool.

18. The tool according to claim 15 further including a stop adapted to permit a relative movement of said lifting member and said cutting mechanism.

19. The tool according to claim 10 further including a guide member adapted to direct a substantially continuous section of said flooring during further separation of said substantially continuous section of said flooring from said subfloor.

20. The tool according to claim 19 wherein said guide member directs said substantially continuous section of said flooring away from said lifting member.

21. The tool according to claim 19 wherein said guide member further includes a directional-movement feature that defines a passage into which the said substantially continuous section of said flooring is directed, said directional-movement feature preventing withdrawal of said substantially continuous section of said flooring from said passage when said substantially continuous section of said flooring is inserted through the passage in one direction.

22. The tool according to claim 19 wherein said guide is removably fastened to said tool.

23. The tool according to claim 10 wherein said pivotable leverage member and said lifting member are integral.

24. The tool according to claim 10 wherein said lifting member is generally arcuate.

25. The tool according to claim 24 wherein said lifting member is generally cylindrical.

26. The tool according to claim 25 wherein said lifting member is a cylinder.

27. The tool according to claim 25 wherein said lifting member is a plurality of spaced wheels.

28. The tool according to claim 25 wherein said lifting member is adapted to be capable of smoothing a new flooring.

29. The tool according to claim 10 further including a positioning member movably mounted to said tool.

30. The tool according to claim 29 wherein said positioning member further includes a handle adapted to assist with positioning said tool.

31. The tool according to claim 10 wherein said tool is manually movable.

32. The tool according to claim 31 wherein said tool can be moved by one person.

33. The tool according to claim 31 wherein said manual movement involves rolling said lifting member.

34. The tool according to claim 10 further including a locking feature for facilitating a movement of said tool.

35. The tool according to claim 10 further including at least one removably fastened starting mechanism.

36. The tool according to claim 35 wherein said starting mechanism includes a link having a first end adapted to connect to said tool and a second end adapted to connect to a portion of said flooring.

37. The tool according to claim 36 wherein said link is a strap.

38. The tool according to claim 36 wherein said link is a chain.

39. The tool according to claim 36 wherein said link is a cable.

40. The tool according to claim 36 wherein said link is a rope.

41. The tool according to claim 10 wherein said flooring is a sheet product.

42. The tool according to claim 41 wherein said sheet product is carpet.

43. The tool according to claim 41 wherein said sheet product is one of a linoleum, a linoleum replacement, or a vinyl.

44. A tool for removing a flooring affixed to a subfloor, said tool comprising:

(a) a lifting member adapted to be positioned adjacent to said flooring in a manner that permits an exertion of a force on said flooring;

(b) a pivotable leverage member adapted to communicate an applied pivot force as said exertion force through said lifting member to said flooring to thereby separate said flooring from said subfloor, wherein said lifting member and said pivotable leverage member are adapted to permit the separation of said flooring from said subfloor as substantially continuous sections; and (c) a securing feature adapted to secure at least a portion of said flooring to said tool, wherein said securing feature is adapted to secure at least a portion of said flooring to said tool at least simultaneously with said applied pivot force communicating as said exertion force through said lifting member to thereby separate said flooring from said subfloor.

45. The tool according to claim 44 wherein said securing feature includes said pivotable leverage member having a first length pivotally joined to a second length to permit securing said at least a portion of said flooring to said tool.

46. The tool according to claim 45 wherein said first length and said second length are adapted to permit a cooperation of said pivotable leverage member and said lifting member to secure said at least a portion of said flooring to said tool.

47. The tool according to claim 46 wherein said lifting member has a rigidity adapted to permit said cooperation of said pivotable leverage member and said lifting member to secure said at least a portion of said flooring to said tool.

48. The tool according to claim 44 wherein said securing feature is substantively continuous.

49. The tool according to claim 44 wherein said securing feature includes a plurality of elements.

50. The tool according to claim 49 wherein said plurality of elements are arcuate members.

51. The tool according to claim 50 wherein said arcuate members further include serrations adapted to grip said at least a portion of said flooring.

52. The tool according to claim 44 wherein said securing feature is integral with said pivotable leverage member.

53. The tool according to claim 52 wherein said integral securing feature further includes a biasing member adapted to assist securing said at least a portion of said flooring to said tool and a retractor adapted to permit release of said at least a portion of said flooring.

54. The tool according to claim 44 wherein said lifting member has a size that permits a substantially continuous section of said flooring to be wrapped thereon.

55. The tool according to claim 44 wherein said pivotable leverage member and said lifting member are adapted to permit the substantial complete separation of a substantially continuous section of said flooring from said subfloor without wrapping said substantially continuous section of said flooring on said tool.

56. The tool according to claim 44 wherein said applied force is applied manually.

57. The tool according to claim 56 wherein said applied force can be applied by one person.

58. The tool according to claim 44 further including a cutting mechanism adapted to cutting said flooring to facilitate a removal of a substantially continuous section of said flooring from said subfloor.

59. The tool according to claim 58 wherein said cutting mechanism is adapted to cut substantially simultaneously with said applied force communicating as said exertion force.

60. The tool according to claim 58 wherein said cutting mechanism is removably fastened to said tool.

61. The tool according to claim 58 further including a stop adapted to permit a relative movement of said lifting member and said cutting mechanism.

62. The tool according to claim 44 further including a guide member adapted to direct a substantially continuous section of said flooring during further separation of said substantially continuous section of said flooring from said subfloor.

63. The tool according to claim 62 wherein said guide member directs said substantially continuous section of said flooring away from said lifting member.

64. The tool according to claim 62 wherein said guide member further includes a directional-movement feature that defines a passage into which the said substantially continuous section of said flooring is directed, said directional-movement feature preventing withdrawal of said substantially continuous section of said flooring from said passage when said substantially continuous section of said flooring is inserted through the passage in one direction.

65. The tool according to claim 62 wherein said guide is removably fastened to said tool.

66. The tool according to claim 44 wherein said pivotable leverage member and said lifting member are integral.

67. The tool according to claim 44 wherein said lifting member is generally arcuate.

68. The tool according to claim 67 wherein said lifting member is generally cylindrical.

69. The tool according to claim 68 wherein said lifting member is a cylinder.

70. The tool according to claim 68 wherein said lifting member is a plurality of spaced wheels.

71. The tool according to claim 68 wherein said lifting member is adapted to be capable of smoothing a new flooring.

72. The tool according to claim 44 further including a positioning member movably mounted to said tool.

73. The tool according to claim 72 wherein said positioning member further includes a handle adapted to assist with positioning said tool.

74. The tool according to claim 44 wherein said tool is manually movable.

75. The tool according to claim 74 wherein said tool can be moved by one person.

76. The tool according to claim 74 wherein said manual movement involves rolling said lifting member.

77. The tool according to claim 44 further including a locking feature for facilitating a movement of said tool.

78. The tool according to claim 44 further including at least one removably fastened starting mechanism.

79. The tool according to claim 78 wherein said starting mechanism includes a link having a first end adapted to connect to said tool and a second end adapted to connect to a portion of said flooring.

80. The tool according to claim 79 wherein said link is a strap.

81. The tool according to claim 79 wherein said link is a chain.

82. The tool according to claim 79 wherein said link is a cable.

83. The tool according to claim 79 wherein said link is a rope.

84. The tool according to claim 44 wherein said flooring is a sheet product.

85. The tool according to claim 84 wherein said sheet product is carpet.

86. The tool according to claim 84 wherein said sheet product is one of a linoleum, a linoleum replacement or a vinyl.

87. A method for removing a flooring affixed to a subfloor comprising:

(a) positioning a lifting member adjacent to said flooring in a manner that permits an exertion of a force on said flooring;

(b) securing a portion of said flooring to said tool with an assistance of a biasing member;

(c) applying a force to a pivotable leverage member to communicate said applied force as said exertion force through said lifting member to said flooring to thereby separate said flooring from said subfloors, and (d) retracting said biasing member to release of said at least a portion of said flooring.

88. A method for removing a flooring affixed to a subfloor comprising:

(a) positioning a lifting member adjacent to said flooring in a manner that permits an exertion of a force on said flooring;

(b) securing a portion of said flooring to said tool with an assistance of a biasing member;

(c) applying a force to a pivotable leverage member to communicate said applied force as said exertion force through said lifting member to said flooring to thereby separate said flooring from said subfloor;

(d) retracting said biasing member to release of said at least a portion of said flooring; and (e) repeating steps (a) through (d) to permit the separation of said flooring from said subfloor as substantially continuous sections.

89. A method for removing a flooring affixed to a subfloor comprising:

(a) positioning a lifting member adjacent to said flooring in a manner that permits an exertion of a force on said flooring;

(b) applying a pivot force to a pivotable leverage member to communicate said applied divot force as said exertion force through said lifting member to said flooring to thereby separate said flooring from said subfloor;

(c) securing at least a portion of said flooring to one of said lifting member and said pivotable leverage member at least simultaneously with said applied pivot force communicating as said exertion force; and (d) repeating steps (a), (b) and (c) to permit the separation of said flooring from said subfloor as substantially continuous sections.

* * * * *

UNITED STATES PATENT AND TRADEMARK OFFICE

CERTIFICATE OF CORRECTION

PATENT NO. : 6,613,188 B1
DATED : September 2, 2003
INVENTOR(S) : Jeffrey P. Berg et al.

It is certified that error appears in the above-identified patent and that said Letters Patent is hereby corrected as shown below:

Column 14,
Line 7, the word "divot" should be -- pivot. --

Signed and Sealed this

Third Day of February, 2004

JON W. DUDAS
*Acting Director of the United States Patent and Trademark Office*